US006230625B1

(12) United States Patent
Neyer et al.

(10) Patent No.: US 6,230,625 B1
(45) Date of Patent: May 15, 2001

(54) DISARMABLE FIRING MODULE

(75) Inventors: Barry T. Neyer, Cincinnati; John T. Adams, Bellbrook; T. Andrew Demana, Dayton; James C. Edwards, Middletown; Daniel R. Knick, Dayton; Robert J. Tomasoski, Centerville, all of OH (US)

(73) Assignee: PerkinElmer, Inc., Wellesley, MA (US)

( * ) Notice: Subject to any disclaimer, the term of this patent is extended or adjusted under 35 U.S.C. 154(b) by 0 days.

(21) Appl. No.: 09/286,522

(22) Filed: Apr. 6, 1999

(51) Int. Cl.[7] ..... F42C 19/12; F42B 3/198; F42B 3/12

(52) U.S. Cl. ..... 102/221; 102/221; 102/202.5; 102/202.7; 102/202.14; 102/206; 102/200

(58) Field of Search ..... 102/221, 200, 102/202, 202.9, 202.5, 202.14, 206

(56) References Cited

U.S. PATENT DOCUMENTS 4,291,623 * 9/1981 Robinson et al. ..... 102/310
4,938,137 * 7/1990 Guay ..... 102/202.7
5,831,203 * 11/1998 Ewick ..... 102/202.5
5,969,286 * 10/1999 Ward et al. ..... 102/202.7

* cited by examiner

*Primary Examiner*—Michael J. Carone
*Assistant Examiner*—Lulit Semunegus
(74) *Attorney, Agent, or Firm*—Iandiorio & Teska

(57) ABSTRACT

A disarmable firing module with a firing module housing having an opening therein; a detonator holder received in the firing module housing via the opening in the firing module housing, the detonator holder including a cavity therein; a detonator disposed in the cavity of the detonator holder; and a detonator electronics assembly housed within the firing module housing. The detonator holder is removably secured within the housing which allows the detonator to be separated from the detonator electronics assembly to disarm the firing module.

11 Claims, 3 Drawing Sheets

DISARMABLE FIRING MODULE

FIELD OF INVENTION

This invention relates to firing module for detonating explosives, the firing module including a unique insertable and removable detonator which renders the firing module inert for handling, transportation, testing, and demilitarization.

BACKGROUND OF INVENTION

Firing modules used in military weapon and other systems typically include an electronics assembly secured within a housing and a detonator permanently electrically connected to the electronics assembly and permanently potted within the housing. The firing module is inserted into a bulkhead containing a primary explosive and when the electronics assembly is activated it fires the detonator causing the primary explosive to explode.

Firing modules of the prior art are assembled and once completed they are active due to the presence of the detonator and therefore must be handled and transported with extreme caution. In addition, the only way to test the electronics assembly is to initiate detonation which destroys the firing module. Therefore, in the prior art, only a small percentage of a given lot of firing modules could be tested. Moreover, to demilitarize weapon systems including prior art firing modules, the firing modules must be destroyed using special precautions due to the presence of the detonator. Because the detonator is permanently connected to the electronics assembly, the electronics assembly cannot be scrapped or reworked like other electronic assemblies adding significantly to the cost of the demilitarizing such weapons systems. The high cost of demilitarizing weapons systems is currently a significant factor in the design of new weapons systems.

SUMMARY OF INVENTION

It is therefore an object of this invention to provide a firing module with an insertable and removable detonator.

It is a further object of this invention to provide such a firing module which can be easily disarmed and rendered inert for handling and shipping.

It is a further object of this invention to provide such a firing module which can be completely tested in a nondestructive fashion.

It is a further object of this invention to provide such a firing module which can be mass produced, rendered inert for handling, transportation and complete testing and then easily re-assembled for use.

It is a further object of this invention to provide such a firing module which is simple in design, easy to manufacture, and which adds little to the cost of manufacturing the firing module.

It is a further object of this invention to provide a firing module which can be demilitarized in a cost effective manner.

This invention results from the realization that a firing module can be more safely handled, transported and demilitarized, and also fully tested without activating the detonator by constructing a detonator holder for the detonator and by adding fasteners to the detonator electronics assembly which allow the detonator holder to be secured to the electronics assembly but also separated from the electronics assembly and removed from the firing module housing to nondestructively test the electronics assembly and render the firing module inert for handling, shipping, and demilitarization.

This invention features a disarmable firing module comprising a firing module housing with an opening therein; a detonator holder received in the firing module housing via the opening in the firing module housing, the detonator holder including a cavity therein; a detonator disposed in the cavity of the detonator holder; a detonator electronics assembly housed within the firing module housing; and means for removably securing the detonator holder within the housing to separate the detonator from the detonator electronics assembly and thereby disarm the firing module.

The means for removably securing may include a pair of studs upstanding from the electronic assembly and a pair of orifices through the detonator holder for receiving the studs. The detonator holder orifices preferably include a shouldered portion providing a seat for fasteners positioned on the studs. The detonator electronics assembly may include a circuit card having electrical contacts thereon for initiating the detonator, the means for removably securing including at least one fastener on the circuit card which properly positions the detonator on the electrical contacts.

The disarmable firing module of this invention features a firing module housing; a detonator electronics assembly disposed within the firing module housing; a detonator; and means for removably coupling the detonator with respect to the detonator electronics assembly. Such means may include a detonator holder at least partially enclosing the detonator, an opening in the firing module housing for receiving the detonator holder, and at least one fastener securing the detonator holder within the housing and for coupling the detonator to the electronics assembly.

More broadly, the invention comprises a disarmable firing module with a firing module housing; a detonator; an electronics assembly within the housing for activating the detonator; and means for disarming the firing module and rendering it inert.

The means for disarming preferably includes means for separating the detonator from the electronics assembly such as a detonator holder disposed at least partially about the detonator, the detonator holder receivable within the firing module housing, and at least one fastener for removably securing the detonator holder to the electronics assembly.

Another aspect of the disarmable firing module of this invention is that it covers the combination of a firing module housing; an electronics assembly within the housing for activating a detonator; and a detonator electrically coupled to the electronics assembly when the firing module is active and removable from the electronics assembly to render the firing module inert. In this way, the firing module can be completely tested, handled, and transported in the inert condition. To activate the firing module, the detonator is inserted into the housing and electrically coupled to the electronics assembly. At any time, the firing module can be removed from the weapon system, the detonator removed from the housing, and the electronics assembly tested while the firing module is inert to thereby effect periodic nondestructive testing of the module. The detonator can then be re-inserted into the firing module and the filing module put back in service. Later, to demilitarize the firing module, the detonator is once again removed from the electronics assembly which can then be scrapped or reworked the same manner as other military electronic subassemblies.

DISCLOSURE OF PREFERRED EMBODIMENT

Other objects, features and advantages will occur to those skilled in the art from the following description of a preferred embodiment and the accompanying drawings, in which.

Figure 1:
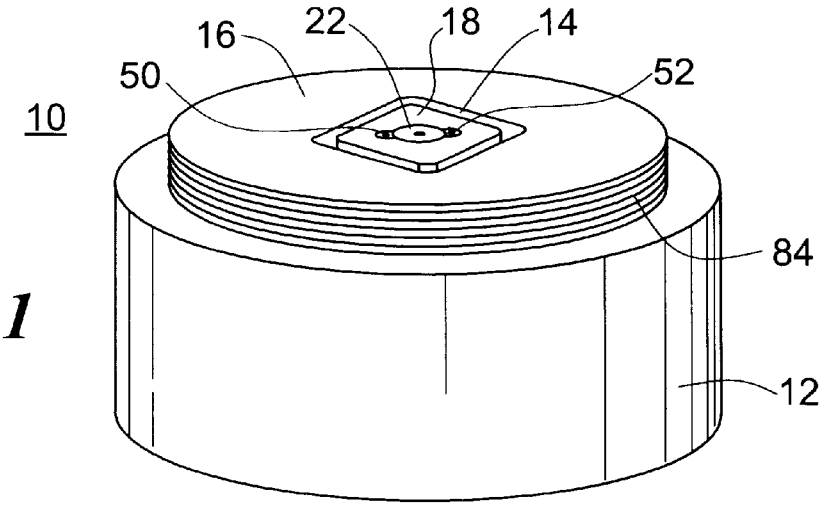
FIG. 1 is a three dimension diagrammatic view of the firing module of the subject invention.

Disarmable firing module 10, FIG. 1 of this invention includes firing module housing 12, opening 14 in top plate 16 of housing 12, and detonator holder 18 removably received in housing 12 through opening 14 as shown.

Figure 2:
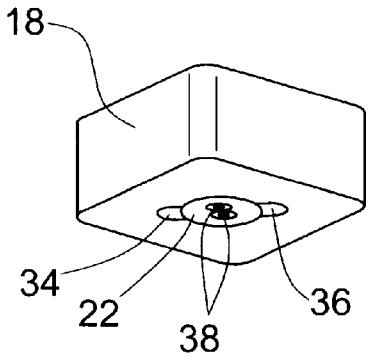
FIG. 2 is a three dimensional diagrammatic view of the detonator holder portion of the firing module shown in FIG. 1.

Detonator holder 18 itself includes cavity 20 (shown more clearly in FIG. 9) therein which receives detonator 22 as shown in FIG. 1 and 2.

Figure 3:
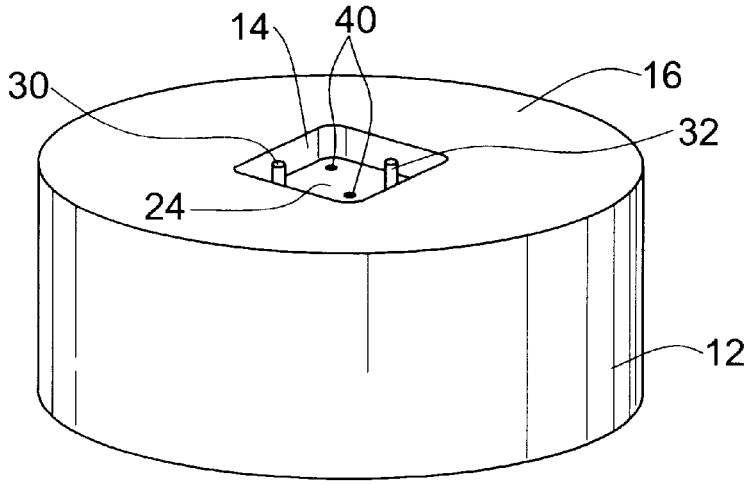
FIG. 3 is a three dimensional diagrammatic view of the firing module of the subject invention with the detonator removed.
Figure 4:
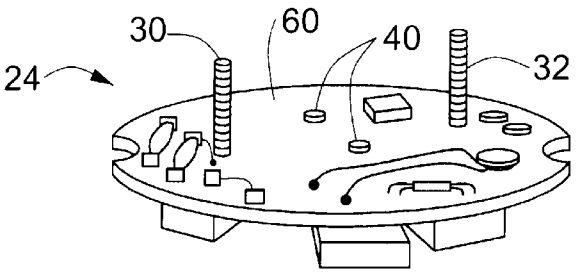
FIG. 4 is a three dimensional diagrammatic view of the electronics assembly of the firing module of the subject invention.

Also within housing 12 is detonator electronics assembly 24, FIGS. 3 and 4. The invention features separate detonator holder 18 and some means to removably secure holder 18 in housing 12 but also to separate detonator 22 with respect to electronics assembly 24 to render module 10 inert for handling, shipping, and nondestructive testing in a way not possible in the prior art.

In the preferred embodiment, such means include studs 30 and 32, FIG. 3 upstanding from the circuit card of electronics assembly 24. Detonator holder 18 includes orifices 34 and 36, FIG. 2 which receive studs 30 and 32 to bring contacts 38 of detonator 22 to mate with contacts 40 of electronics assembly 24. To that end, fasteners 50 and 52, FIG. 1, for example, nuts, are threaded onto studs 30 and 32 to lock detonator holder 18 in place in housing 12.

Therefore, in the configuration shown in FIG. 1, firing module 10 is active because detonator 22 makes electrical contact with electronic assembly 24, FIG. 3.

By simply removing fasteners 50 and 52 FIG. 1, however, detonator holder 18 is easily removed from housing 12 as shown in FIGS. 2 and 3 breaking the electrical contact between detonator 22 and electronics assembly 24. In this way, module 10 is disarmed and rendered inert for handling and shipping, for nondestructive testing of electronics assembly 24, and for demilitarization of module 10 and/or any weapons system of which it is a part.

In the prior art, this was not possible because detonator 22 was permanently potted within the module housing and also permanently attached (e.g. soldered) to the electronics assembly. The result was an always active firing module which could only be handled and transported using specialized precautions and which could not be tested except to fire the detonator which destroyed the module and electronics assembly. Therefore, only a selected small percentage of the firing modules from a given lot could be tested. Moreover, demilitarization of the firing modules required specialized and expensive procedures.

In contrast, each firing module of the subject invention can be nondestructively tested before use or at any other time which is critical in some applications. Also, once detonator holder 18, FIG. 2 is removed from housing 12, FIG. 3, electronics assembly 24 can be demilitarized in a cost effective manner like other inert electronic subassemblies.

The electronic components of firing module electronics assembly 24, FIG. 4 are known in the art and need not be described further here. In the subject invention, one modification includes drilling holes through circuit card 60 and inserting 7⁄32 inch threaded studs 30 and 32 therein as shown.

Other schemes for rendering detonator 22, FIG. 2 removable with respect to electronic subassembly 24, however, are within the scope of this invention. In fact, the invention broadly covers a firing module housing of any configuration, a detonator electronics assembly housed within the firing module housing, a detonator selected from a number of different types of detonators, and some means for removably inserting the detonator into or within the housing and electrically coupling the detonator to the electronic subassembly without damaging the firing module or any of its components.

Figure 5:
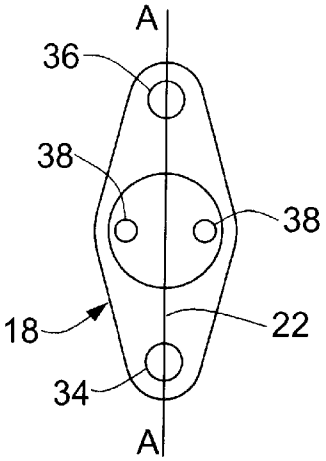
FIG. 5 is a bottom plan view of the detonator holder shown in FIG. 2.

In the preferred embodiment shown in the drawings, studs 30 and 32, FIG. 4 are positioned to precisely align contacts 40 of circuit card 60 with contacts 38 of detonator 22, FIG. 5 when studs 30 and 32 are received in orifices 34 and 36 of detonator holder 18, FIG. 2. This makes activation of the firing module easy in the field. The shape of detonator housing 18, FIG. 2 and the shape of opening 14, FIG. 3 in module housing 12 shown in the drawings, however, are not limitations of the present invention.

Figure 6:
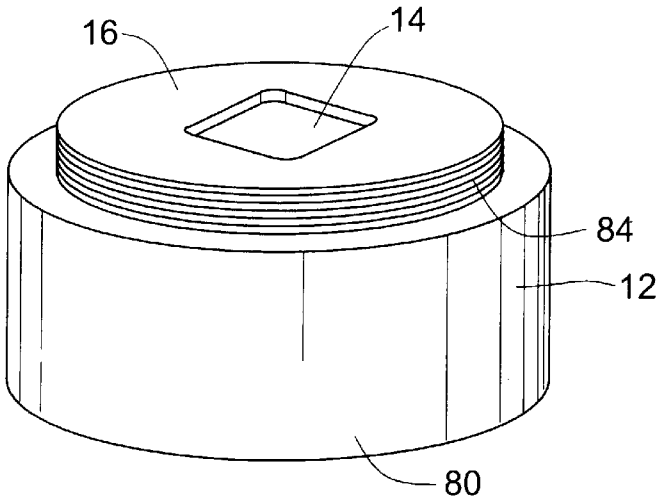
FIG. 6 is a three dimensional diagrammatic view of one portion of the firing module housing of the subject invention.
Figure 7:
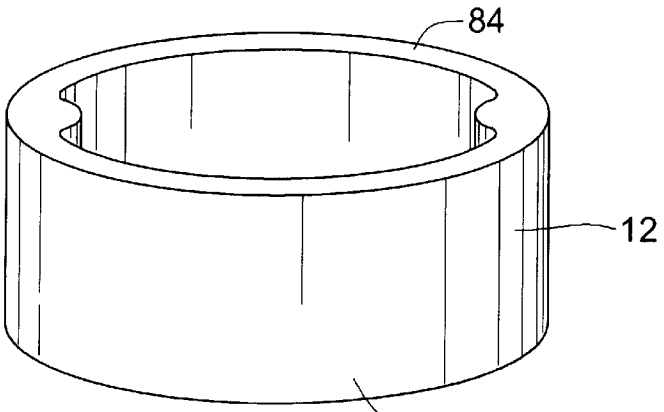
FIG. 7 is a three dimensional diagrammatic view of the firing module housing shown in FIG. 6.
Figure 8:
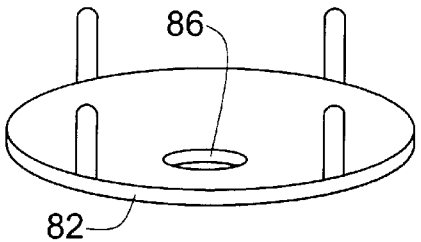
FIG. 8 is a three dimensional diagrammatic view of the bottom plate of the firing module housing of the subject invention.

Housing 12, FIG. 6 typically includes top plate 16 (in one embodiment 1½ inch in diameter), circular wall 80 (for example ¾ inches tall), and bottom plate 82, FIG. 8 which seats on bottom surface 84, FIG. 7, of wall 80.

Top plate 16, FIGS. 1 and 6 includes threads 84 around the circumference thereof for mating the module with a bulkhead or the like which would include the primary explosive to be detonated by detonator 22, FIG. 1. Orifice 86 in bottom plate 82, FIG. 8 receives electrical wires extending from an electronics assembly 24, FIG. 4.

Figure 9:
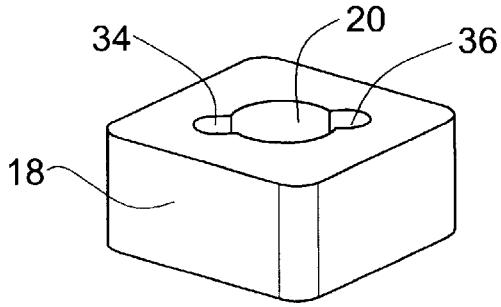
FIG. 9 is a three dimensional diagrammatic view of the detonator holder shown in FIG. 2 with the detonator removed.
Figure 10:
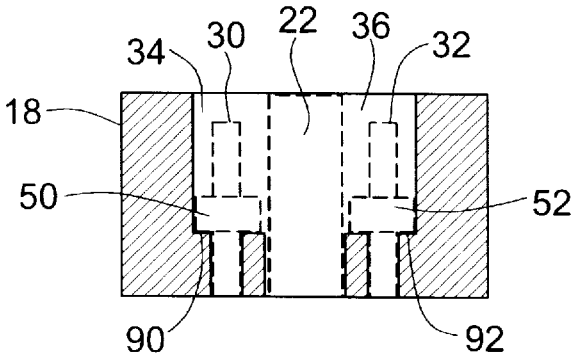
FIG. 10 is a front sectional view of the detonator holder shown in FIG. 9.

As shown more clearly in FIGS. 9 and 10, detonator holder 18 with stud receiving orifices 34 and 36 includes shouldered portions 90 and 92 which provide a seat for fasteners 50 and 52 respectfully. In this way, the combination of studs 30 and 32, FIG. 4 upstanding from circuit card 60 and nuts 50 and 52 which seat against the shouldered portions 90 and 92 of detonator holder 18 retain the detonator within the housing of the firing module insuring that the detonator is in secure electrical contact with the detonator electronics assembly when it is desired to use the firing module.

Detonator 22, FIGS. 1 and 2 is conventional and may include chip slapper 110 residing on support surface 112 of transistor "TO" package base 114. Chip slapper 110 includes chip base 116 made of an insulating material, usually ceramic. Opposing conductive copper lands 118 and 120 deposited on chip base 116 are separated by or joined by a narrow bridge portion upon which flying plate 122 (e.g. a piece of polyimide) is secured. Base 114 also includes header wall 124, flange 126, and lead posts such as post 128 rising above support surface 112. One set of lead posts is positioned adjacent one conductive land of the chip slapper and the other set of lead posts is positioned adjacent the other conductive land as shown. Additional sets of lead posts or pins could be used for other functions such as a four wire measurement of the bridge resistance.

An electrical connection is made between these lead posts and the conductive lands via individual wires such as shown for wire 130. One end of each wire is usually bonded to a lead post and the other end of each wire is bonded to a land as shown.

Explosive charge 132 includes optional metal sleeve 134 housing explosive 136 is then oriented such that there is an exact and proper spacing between flying plate 122 and explosive 136. This is usually accomplished by using mechanical spacer 140 disposed between support surface 112 of base 114 and explosive charge 132. Some designs have the spacer built in to the chip slapper. Transistor can 142 is placed over this assembly and rim 144 of circular enclosure wall 146 is welded to disk shaped flange 126 of base 114.

Figure 11:
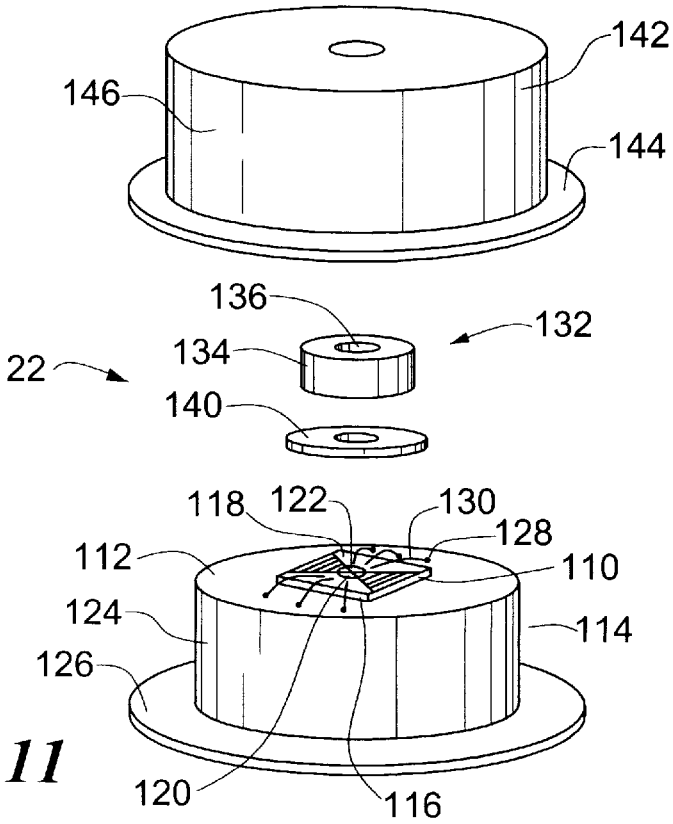
FIG. 11 is an exploded three dimensional schematic view of one type of detonator used in accordance with the subject invention.

To initiate detonation, a high amperage electrical current is applied by electronics assembly 24, FIG. 4, via contacts 40 through contacts 38, FIG. 5 of detonator 22 which are in electrical contact with lead posts 128, FIG. 11. The narrow bridge portion between or interconnecting opposing conductive lands 118 and 120 can not withstand the high amperage current and thus chip slapper 110 bursts and sends flying plate 122 to strike explosive charge 136 which, in turn, explodes thereby detonating the main explosive.

Improvements in this design are delineated in application Ser. No. 09/009,784 incorporated herein by this reference. But, many different kinds of detonators will work as a subassembly of firing module 10, FIG. 1.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A disarmable firing module comprising:

a firing module housing with an opening therein;

a detonator holder received in the firing module housing via the opening in the firing module housing, the detonator holder including a cavity therein;

a detonator disposed in the cavity of the detonator holder; a detonator electronics assembly housed within the firing module housing; and means for removably securing the detonator holder within the housing to separate the detonator from the detonator electronics assembly and thereby disarm the firing module without damaging it or any of its components.

2. The firing module of claim 1 in which the means for removably securing includes a pair of studs upstanding from the electronic assembly and a pair of orifices through the detonator holder for receiving the studs.

3. The firing module of claim 2 in which the detonator holder orifices include a shouldered portion providing a seat for fasteners positioned on the studs.

4. The firing module of claim 1 in which the detonator electronics assembly includes a circuit card having electrical contacts thereon for initiating the detonator, the means for removably securing including at least one fastener on the circuit card which properly positions the detonator on the electrical contacts.

5. A disarmable firing module comprising:

a firing module housing;

a detonator electronics assembly disposed within the firing module housing;

a detonator; and means for removably coupling the detonator with respect to the detonator electronics assembly.

6. The firing module of claim 5 in which the means for removably coupling includes a detonator holder at least partially enclosing the detonator, an opening in the firing module housing for receiving the detonator holder, and at least one fastener securing the detonator holder within the housing and for coupling the detonator to the electronic assembly.

7. A disarmable firing module comprising:

a firing module housing;

a detonator;

an electronics assembly within the housing for activating the detonator; and means for disarming the firing module and rendering it inert.

8. The firing module of claim 7 in which the means for disarming includes means for separating the detonator from the electronics assembly.

9. The firing module of claim 8 in which the means for separating includes a detonator holder disposed at least partially about the detonator, the detonator holder receivable within the firing module housing, and at least one fastener for removably securing the detonator holder to the electronics assembly.

10. A disarmable firing module comprising:

a firing module housing;

an electronics assembly within the housing for activating a detonator; and a detonator electrically coupled to the electronics assembly when the firing module is active and removable from the electronics assembly to render the firing module inert.

11. A disarmable firing module comprising:

a detonator holder housing a detonator including electrical input contacts;

a firing module housing including detonator electronics therein and electrical output contacts mateable with the input contacts of the detonator for detonating the detonator; and wherein the detonator holder is configured to be quickly and easily separable from the firing module housing to de-mate the input contacts of the detonator with respect to the electrical output contacts of the detonator electronics thereby disarming the firing module without damaging it or any of its components.

* * * * *

US006230625C1

(12) EX PARTE REEXAMINATION CERTIFICATE (8356th)

United States Patent

Neyer et al.

(10) Number: US 6,230,625 C1

(45) Certificate Issued: Jun. 28, 2011

(54) DISARMABLE FIRING MODULE

(75) Inventors: Barry T. Neyer, Cincinnati, OH (US); John T. Adams, Bellbrook, OH (US); T. Andrew Demana, Dayton, OH (US); James C. Edwards, Middletown, OH (US); Daniel R. Knick, Dayton, OH (US); Robert J. Tomasoski, Centerville, OH (US)

(73) Assignee: Lumen Technologies, Waltham, MA (US)

Reexamination Request:
No. 90/009,651, Jan. 14, 2010

Reexamination Certificate for:

| | |
|---|---|
| Patent No.: | **6,230,625** |
| Issued: | **May 15, 2001** |
| Appl. No.: | **09/286,522** |
| Filed: | **Apr. 6, 1999** |

(51) Int. Cl.

| | |
|---|---|
| ***F42C 19/12*** | (2006.01) |
| ***F42B 3/198*** | (2006.01) |
| ***F42B 3/12*** | (2006.01) |

(52) U.S. Cl. ..... 102/221; 102/202.5; 102/202.7; 102/202.14; 102/206; 102/200

(58) Field of Classification Search ..... None
See application file for complete search history.

(56) References Cited

U.S. PATENT DOCUMENTS

| | | | |
|---|---|---|---|
| 4,291,623 | A | 9/1981 | Robinson et al. |
| 4,577,402 | A | 3/1986 | Swanstrom |
| 4,603,375 | A | 7/1986 | Miller et al. |
| 4,708,062 | A | 11/1987 | Bjork et al. |

FOREIGN PATENT DOCUMENTS

CA 2132148 A1 3/1996

OTHER PUBLICATIONS

Symposium publication entitled "Technology Symposium for High Energy Switches and Electro–Explosive Systems", Aug. 13–15, 1996.

Knick et al., "Electronic Safe and Arming Devices for use with Non–Interrupted Explosive Initiation", AIAA 97–2961 (1997).

*Primary Examiner*—Jeffrey R. Jastrzab

(57) ABSTRACT

A disarmable firing module with a firing module housing having an opening therein; a detonator holder received in the firing module housing via the opening in the firing module housing, the detonator holder including a cavity therein; a detonator disposed in the cavity of the detonator holder; and a detonator electronics assembly housed within the firing module housing. The detonator holder is removably secured within the housing which allows the detonator to be separated from the detonator electronics assembly to disarm the firing module.

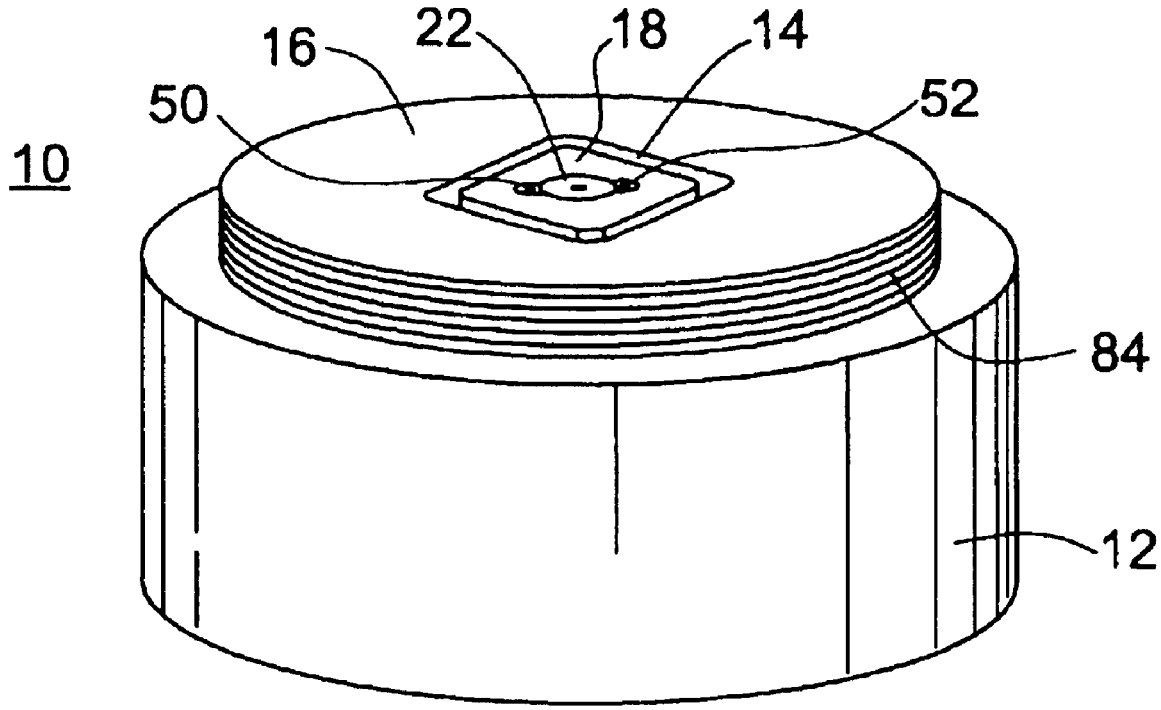

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3 and 4 is confirmed.

Claims 1, 2 and 5-11 are cancelled.

New claims 12-21 are added and determined to be patentable.

*12. A disarmable firing module comprising:*

*a firing module housing configured to mate with a compartment containing a primary explosive, the firing module housing including a cavity in a top surface thereof;*

*a detonator electronic circuit board in the cavity including electronic components thereon, posts extending upwards therefrom, and electrical contacts thereon;*

*a detonator holder about a detonator and removably received in the firing module cavity, the detonator holder including orifices receiving said posts of the circuit board therethrough, the detonator including electrical contacts mating with the contacts on the electronic circuit board when the detonator holder is placed in the cavity of the firing module housing; and*

*a chip slapper in the detonator activating an explosive charge in the detonator when electrical current is applied to the electrical contacts on the circuit board.*

*13. The disarmable firing module of claim 12 in which the detonator holder orifices each include a shouldered portion providing a seat for fasteners positioned on the posts.*

*14. The disarmable firing module of claim 12 in which the detonator electronic circuit board includes firing circuitry connected to the electrical contacts of the electronic circuit board supplying a high amperage electrical current thereto.*

*15. The disarmable firing module of claim 14 in which the chip slapper includes opposing conductive lands on an insulative chip base.*

*16. The disarmable firing module of claim 15 in which the chip base resides on a package base including electrical connections between the opposing conductive lands and the electrical contacts of the detonator mating with the electrical contacts on the electronic circuit board when the detonator holder is placed in the cavity of the firing module housing.*

*17. The disarmable firing module of claim 15 in which there is an explosive charge over the opposing conductive loads on the insulative chip base.*

*18. The disarmable firing module of claim 17 in which there is a spacer between the explosive charge and the insulative chip base.*

*19. The disarmable firing module of claim 17 in which there is a sleeve about the explosive charge.*

*20. The disarmable firing module of claim 16 in which there is a cover sealed to the package base and the cover and the base reside in the detonator holder.*

*21. A disarmable firing module comprising:*

*a firing module housing configured to mate with a compartment containing a primary explosive, the firing module housing including a cavity in a top surface thereof;*

*a detonator electronic circuit board in the cavity including electronic components thereon, posts extending upwards therefrom, and electrical contacts thereon;*

*a detonator holder about a detonator and removeably received in the firing module cavity, the detonator holder including orifices receiving said posts of the detonator electronic circuit board therethrough, the detonator including electrical contacts mating with the contacts on the detonator electronic circuit board when the detonator holder is placed in the cavity of the firing module housing; and*

*the detonator electronic circuit board including firing circuitry connected to the electrical contacts of the detonator electronic circuit board supplying a high amperage electrical current thereto for detonating the detonator via its electrical contacts.*

* * * * *